US006631250B2

(12) United States Patent
Playfair et al.

(10) Patent No.: US 6,631,250 B2
(45) Date of Patent: Oct. 7, 2003

(54) DEVELOPER FILTRATION MODULE

(75) Inventors: David B. Playfair, Penfield, NY (US); James J. Franzen, Fairport, NY (US); Wayne D. Drinkwater, Fairport, NY (US); Jan M. Enderle, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/004,821

(22) Filed: Dec. 7, 2001

(65) Prior Publication Data

US 2003/0108361 A1 Jun. 12, 2003

(51) Int. Cl.[7] ..... G03G 15/08
(52) U.S. Cl. ..... 399/253
(58) Field of Search ..... 399/98, 253, 273, 399/283; 209/309, 324

(56) References Cited

U.S. PATENT DOCUMENTS 4,155,328 A * 5/1979 Navone ..... 399/253
4,523,833 A * 6/1985 Jones ..... 399/272
4,561,381 A * 12/1985 Kaneko et al. ..... 399/270
5,019,870 A * 5/1991 Bares ..... 399/257
5,166,472 A * 11/1992 Maeda et al. ..... 399/281
5,477,307 A * 12/1995 Bergen et al. ..... 399/260
5,600,411 A 2/1997 Hart ..... 399/98
5,710,960 A * 1/1998 Hart et al. ..... 399/253
5,768,666 A * 6/1998 Ito et al. ..... 399/273
6,212,348 B1 * 4/2001 Inoue et al. ..... 399/284

FOREIGN PATENT DOCUMENTS

JP 05289503 A * 11/1993 ..... G03G/15/08

* cited by examiner

*Primary Examiner*—Robert Beatty
(74) *Attorney, Agent, or Firm*—Lloyd F. Dean, II

(57) ABSTRACT

An electrophotographic printing machine, wherein an electrostatic latent image recorded on a photoconductive member is developed to form a visible image thereof, the electrophotographic printing machine including a system, for removing contaminants from toner in a developer housing, the system including a filter system, positioned in a path of flowing developer material, the filter system having a screen for permitting developer material to travel therethrough while inhibiting contaminants from traveling therethrough when vibrated; the screen being inclined to the path of flowing developer material a vibration driver, operatively connected to the screen, for vibrating the screen.

10 Claims, 5 Drawing Sheets

DEVELOPER FILTRATION MODULE

This invention relates generally to a development apparatus for ionographic or electrophotographic imaging and printing apparatuses and machines, and more particularly is directed to a developer filtration module.

Generally, the process of electrophotographic printing includes charging a photoconductive member to a substantially uniform potential so as to sensitize the surface thereof. The charged portion of the photoconductive surface is exposed to a light image from either a digital imaging system [for example a scanning laser beam] or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes, that is sequentially develops, toner powder images of different color toners onto the photoreceptor prior to the transfer of the composite toner powder image onto the substrate. While the image on image process has advantages over other methods for producing color images, it has its own unique set of requirements. One such requirement for noninteractive development systems is that those do not scavenge or otherwise disturb a previously toned image.

Since development systems, such as conventional two component magnetic brush development and AC jumping single component development are known to disturb toner images, they are not in general suited for use in an image on image system. Thus there is a need for noninteractive development systems. There are several types of noninteractive development systems that can be selected for use in an image on image system. Most use a donor roller for transporting charged toner to the development nip; the development nip is defined as the interface region between the donor roller and photoconductive member. In the development nip, the toner is developed on the latent image recorded on the photoconductive member by a combination of mechanical and/or electrical forces. It is the method by which the toner is induced to leave the donor member which primarily differentiates the several options from each other; both single component and two component methods can be utilized for loading toner onto the donor member.

In one version of a noninteractive development system, a plurality of electrode wires are closely spaced from the toned donor roller in the development zone. An AC voltage is applied to the wires to generate a toner cloud in the development zone. The electrostatic fields associated with the latent image attract toner from the toner cloud to develop the latent image. It is this configuration which is utilized in both "Scavengeless Development" and "Hybrid Scavengeless Development".

In another version of noninteractive development, interdigitated electrodes are provided within the surface of a donor roller. The application of an AC bias between the adjacent electrodes in the development zone causes the generation of a toner cloud.

Another type of development technology, known as jumping development, may also be configured to be noninteractive. In jumping development, voltages are applied between a donor roller and the substrate of the photoreceptor member. In one version of jumping development, only a DC voltage is applied to the donor roller to prevent toner deposition in the non-image areas. In the image areas, the electric field from the closely spaced photoreceptor attracts toner from the donor. In another version of jumping development, an AC voltage is superimposed on the DC voltage for detaching toner from the donor roller and projecting the toner toward the photoconductive member so that the electrostatic fields associated with the latent image attract the toner to develop the latent image.

In the system herein before described, it has become highly desirable to have a toner filtering system to remove contamination, particularly in the form of clothing and paper fibers, before the toner reaches the developer housing, to obviate copy quality and machine reliability problems. Also it is desirable to prevent toner particles from adhering together into large scale clumps which ride on the top of the developer material in the developer housing negatively effecting the blending and admixing of the incoming toner.

SUMMARY OF THE INVENTION

One aspect of the invention provides an electrophotographic printing machine, wherein an electrostatic latent image recorded on a photoconductive member is developed to form a visible image thereof, said electrophotographic printing machine including a system, for removing contaminates from toner in a developer housing, the system including a filter system, positioned in a path of flowing developer material, said filter system having a screen for permitting developer material to travel therethrough while inhibiting contaminants from traveling therethrough when vibrated; said screen being inclined to the path of flowing developer material a vibration driver, operatively connected to said screen, for vibrating said screen.

BRIEF DESCRIPTION OF THE FIGURES

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
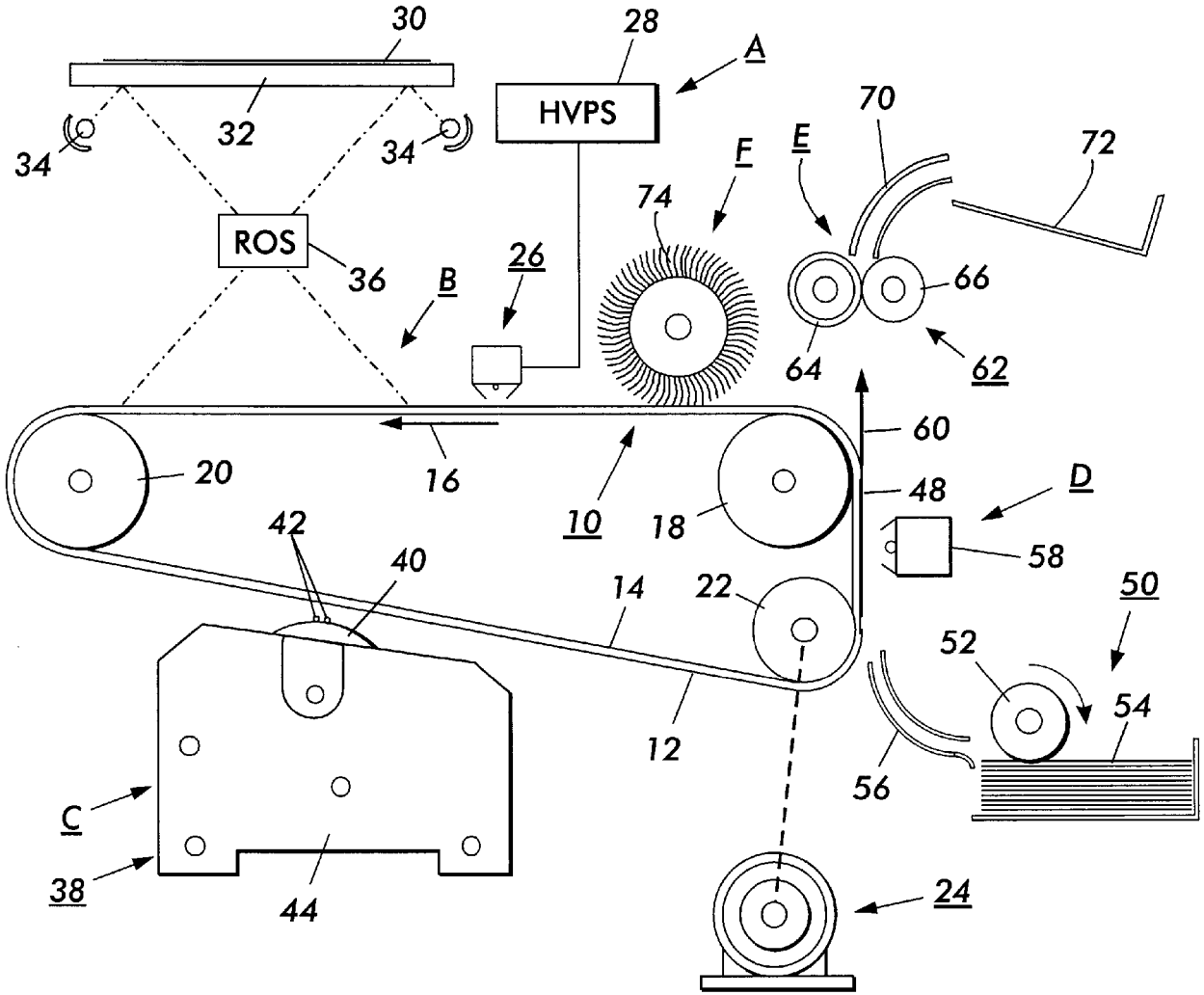
FIG. 1 is a schematic elevational view of an illustrative electrophotographic printing machine incorporating a development apparatus having the features of the present invention therein.

Inasmuch as the art of electrophotographic printing is well known, the various processing stations employed in the FIG. 1 printing machine will be shown hereinafter schematically and their operation described briefly with reference thereto. Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates drive roller 22 to advance belt 10 in the direction of arrow 16. Drive roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely. Initially, a portion of belt 10 passes through charging station A.

At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, RIS contains document illumination lamps, optics, a mechanical scanning drive and a charged coupled device. The RIS captures the entire image from original document 30 and converts it to a series of raster scan lines and moreover measures a set of primary color densities, i.e., red, green and blue densities at each point of the original document. This information is transmitted as electrical signals to an image processing system (IPS). IPS converts the set of red, green and blue density signals to a set of colorant signals. Alternatively, image and/or text original can be externally computer generated and sent to IPS to be printed. which may include a portion image.

The IPS contains control electronics which prepare and manage the image data flow to a raster output scanning device (ROS), indicated by numeral 36. A user interface (UI) is in communication with IPS. UI enables an operator to control the various operator adjustable functions, such as selecting portion document to be printed with a custom color. The operator actuates the appropriate keys of UI to adjust the parameters of the copy. UI may be a touch screen or any other suitable control panel providing an operator interface with the system. The output signal from UI is transmitted to the IPS. The IPS then transmits signals corresponding to the desired image to ROS 36, which creates the output copy image. The ROS illuminates, via mirror, the charged portion of a photoconductive belt 10. The ROS will expose the photoconductive belt to record single to multiple images which correspond to the signals transmitted from IPS., belt 10 advances the latent image to development station C.

At development station C, a developer unit, indicated generally by the reference numeral 38, develops the latent image recorded on the photoconductive surface. Preferably, developer unit 38 includes donor roller 40 and electrode wires 42. Electrode wires 42 are electrically biased relative to donor roller 40 to detach toner therefrom so as to form a toner powder cloud in the gap between the donor roller and photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller.

The development apparatus will be discussed hereinafter, in greater detail, with reference to FIG. 2. With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roller 52 contacting the uppermost sheet of stack 54. Feed roller 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48.

After transfer, sheet 48 continues to move in the direction of arrow 60 onto a conveyor (not shown) which advances sheet 48 to fusing station E. Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle. It is believed that the foregoing description is sufficient for purposes of the present application to illustrate the general operation of an electrophotographic printing machine incorporating the developer unit of the present invention therein.

Figure 2:
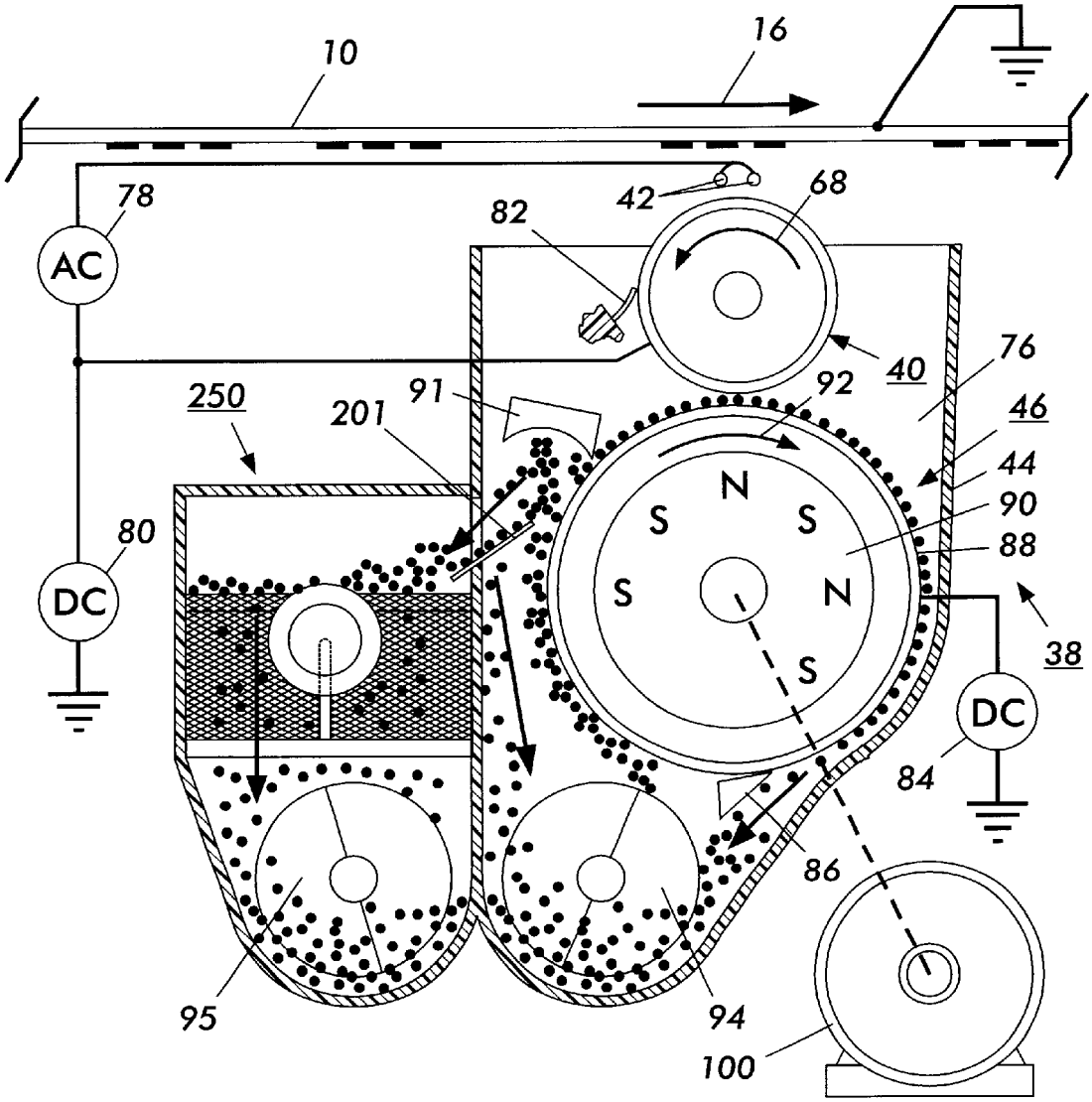
FIG. 2 is a schematic elevational view showing the developer unit used in the FIG. 1 printing machine.

Referring now to FIG. 2, there is shown developer unit 38 in greater detail. As shown thereat, developer unit 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68. Similarly, the magnetic roller can be rotated in either the 'with' or 'against' direction relative to the direction of motion of belt 10.

In FIG. 2, magnetic roller 46 is shown rotating in the direction of arrow 92. Donor roller 40 is preferably made from anodized aluminum. Developer unit 38 also has electrode wires 42 which are disposed in the space between the belt 10 and donor roller 40. A pair of electrode wires are shown extending in a direction substantially parallel to the longitudinal axis of the donor roller. The electrode wires are made from one or more thin (i.e., 50 to 100. mu. diameter) stainless steel wires which are closely spaced from donor roller 40. The distance between the wires and the donor roller is approximately 25. mu. or the thickness of the toner layer on the donor roller. The wires are self-spaced from the donor roller by the thickness of the toner on the donor roller. The ends of the wires are supported by the tops of end bearing blocks which may also support the donor roller for rotation. The wire extremities are attached so that they are slightly below a tangent to the surface, including toner layer, of the donor structure. Mounting the wires in such a manner makes them insensitive to roll runout due to their self-spacing. As illustrated in FIG. 2, an alternating electrical bias is applied to the electrode wires by an AC voltage source 78. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is relatively low and is in the order of 200 to 600 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. At a spacing ranging from about 10. mu. to about 40. mu. between the electrode wires and donor roller, an applied voltage of 200 to 600 volts produces a relatively large electrostatic field without risk of air breakdown.

The use of a dielectric coating on either the electrode wires or donor roller helps to prevent shorting of the applied AC voltage. Blade 82 strips all of the toner from donor roller 40 after development so that magnetic roller 46 meters fresh toner to a clean doner roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller.

Metering blade 86 is positioned closely adjacent to magnetic roller 46 to maintain the compressed pile height of the developer material on magnetic roller 46 at the desired level. Magnetic roller 46 includes a non-magnetic tubular member or sleeve 88 made preferably from aluminum and having the exterior circumferential surface thereof roughened. An elongated multiple magnet 90 is positioned interiorly of and spaced from sleeve 88. Elongated magnet 90 is mounted stationarily. Motor 100 rotates sleeve 88 in the direction of arrow 92. Developer material is attracted to sleeve 88 and advances therewith into the nip defined by donor roller 40 and magnetic roller 46. Toner particles are attracted from the carrier granules on the magnetic roller to the donor roller. Scraper blade 91 removes denuded carrier granules and extraneous developer material from the surface of sleeve 88.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft. As successive electrostatic latent images are developed, the toner particles within the developer material are depleted. A toner dispenser (not shown) stores a supply of toner particles. The toner dispenser is in communication with chamber 76 of housing 44.

As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive.

By way of example, the carrier granules include a low permeability magnetic core having a thin layer overcoat with layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

Developer material advances with tubular member 88 in the direction of arrow 92. Toner particles advance with donor roller 40 in the direction of arrow 68. Any contaminants and/or debris move with the toner particles and developer material in the direction of arrows 92 and 68.

The toner particles, developer material, contaminants and debris flow through a cleaner via a chute 255 from trim bar 91, indicated generally by the reference numeral 250. Cleaner 250 includes a filter screen assembly 210 having a screen. The screen may be fabricated from a thin metal foil or plastic film with the openings formed by any suitable means such as chemical etching, laser machining, or punching. Alternatively, this screen may be fabricated from a woven plastic or metal wire mesh. Yet another method for formation of this screen is the process of electrodeposition of metals. The filter thereby traps fibers while permitting toner and carrier particles to freely flow therethrough. Cleaner 250 is mounted on a support 106. Support 106 is mounted removably on a side wall of developer housing 44. By way of example, support 106 may be mounted slidably in rails secured to the side wall housing 44. In this way, an operator may readily remove cleaner 250 from developer housing 44 at selected maintenance intervals. Further details of cleaner 250 are shown in FIGS. 3 and 4.

Figure 3:
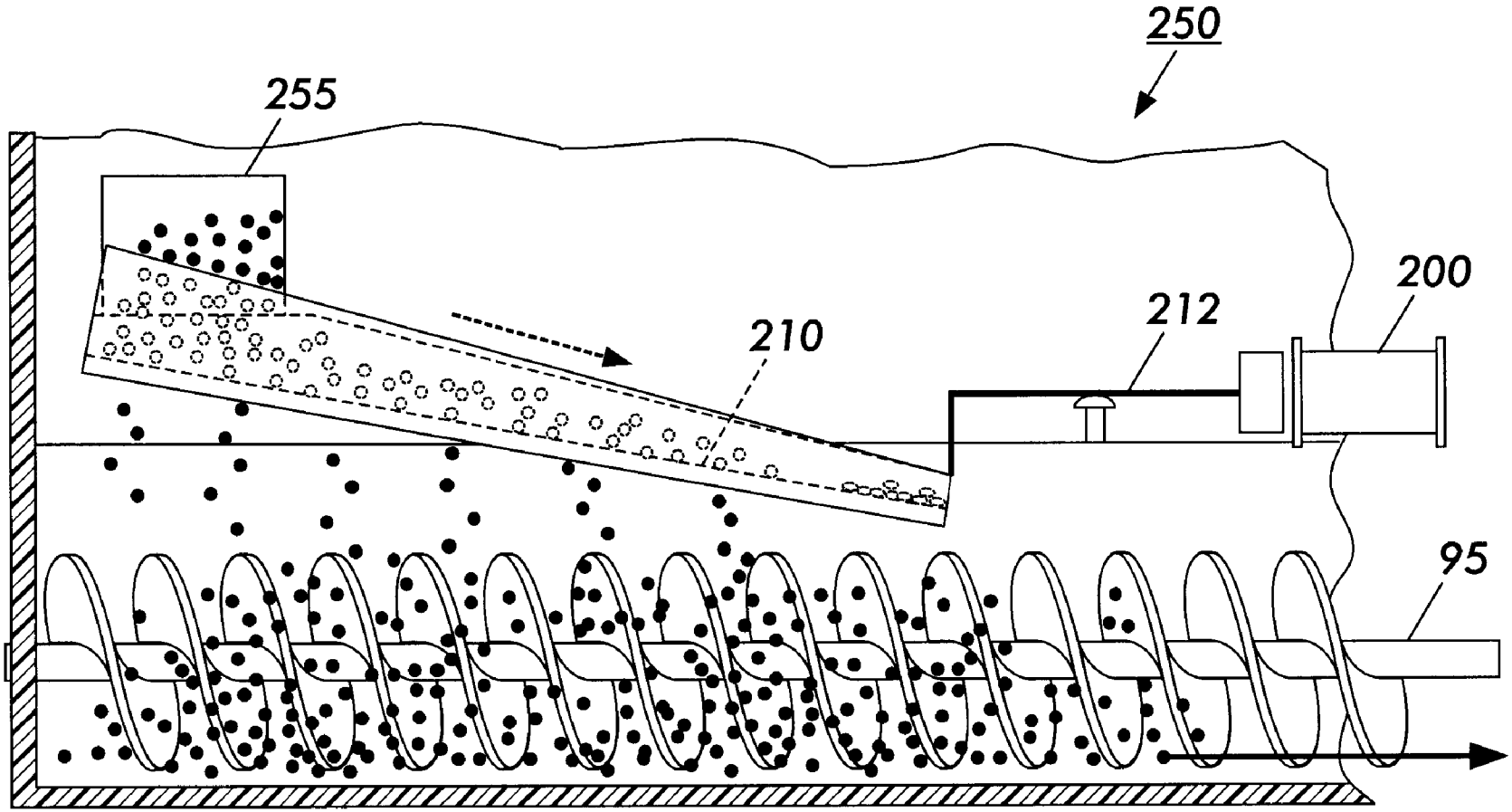
FIGS. 3 and 4 are exploded perspective views of the filter system according to the present invention.
Figure 4:
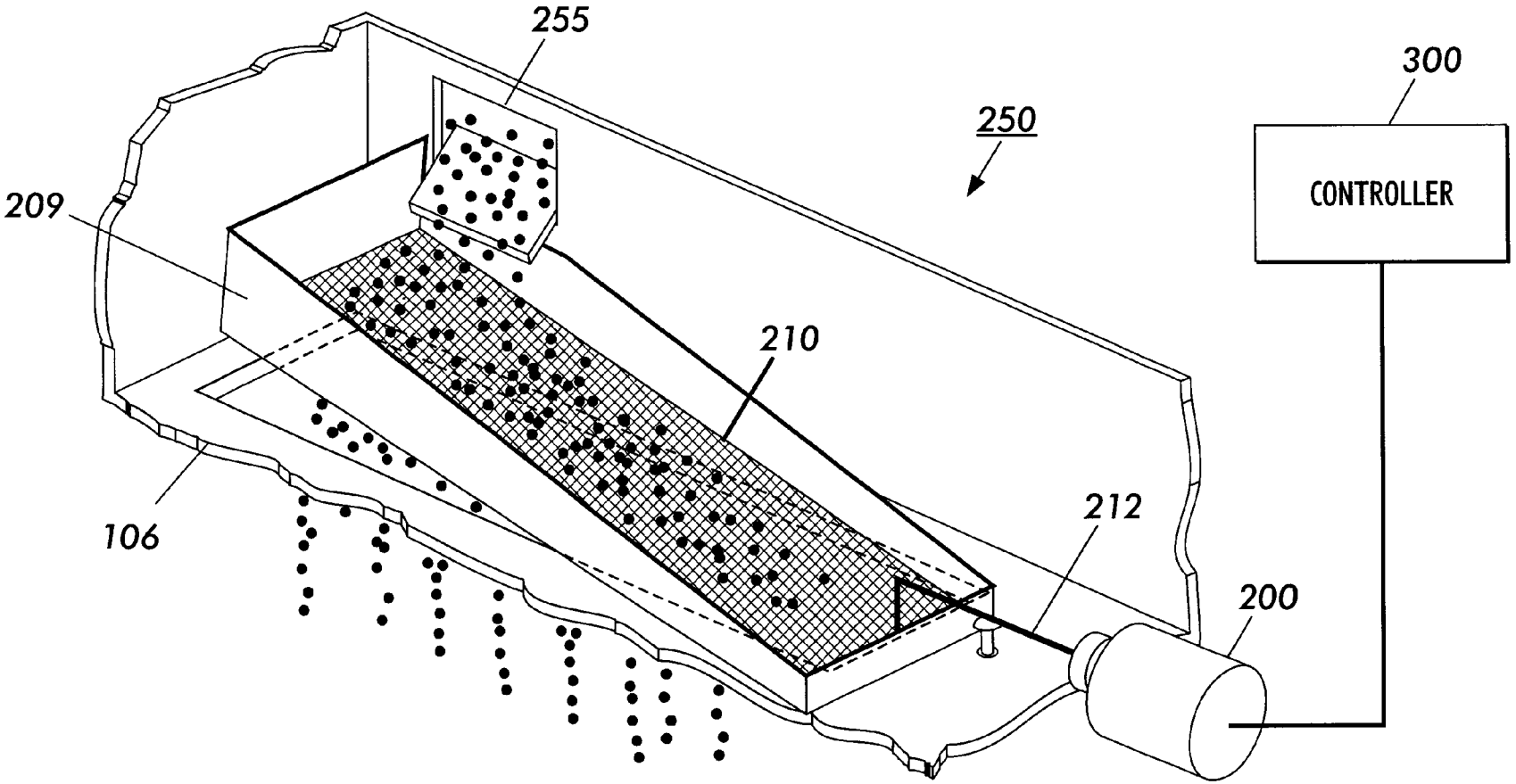
Figure 5:
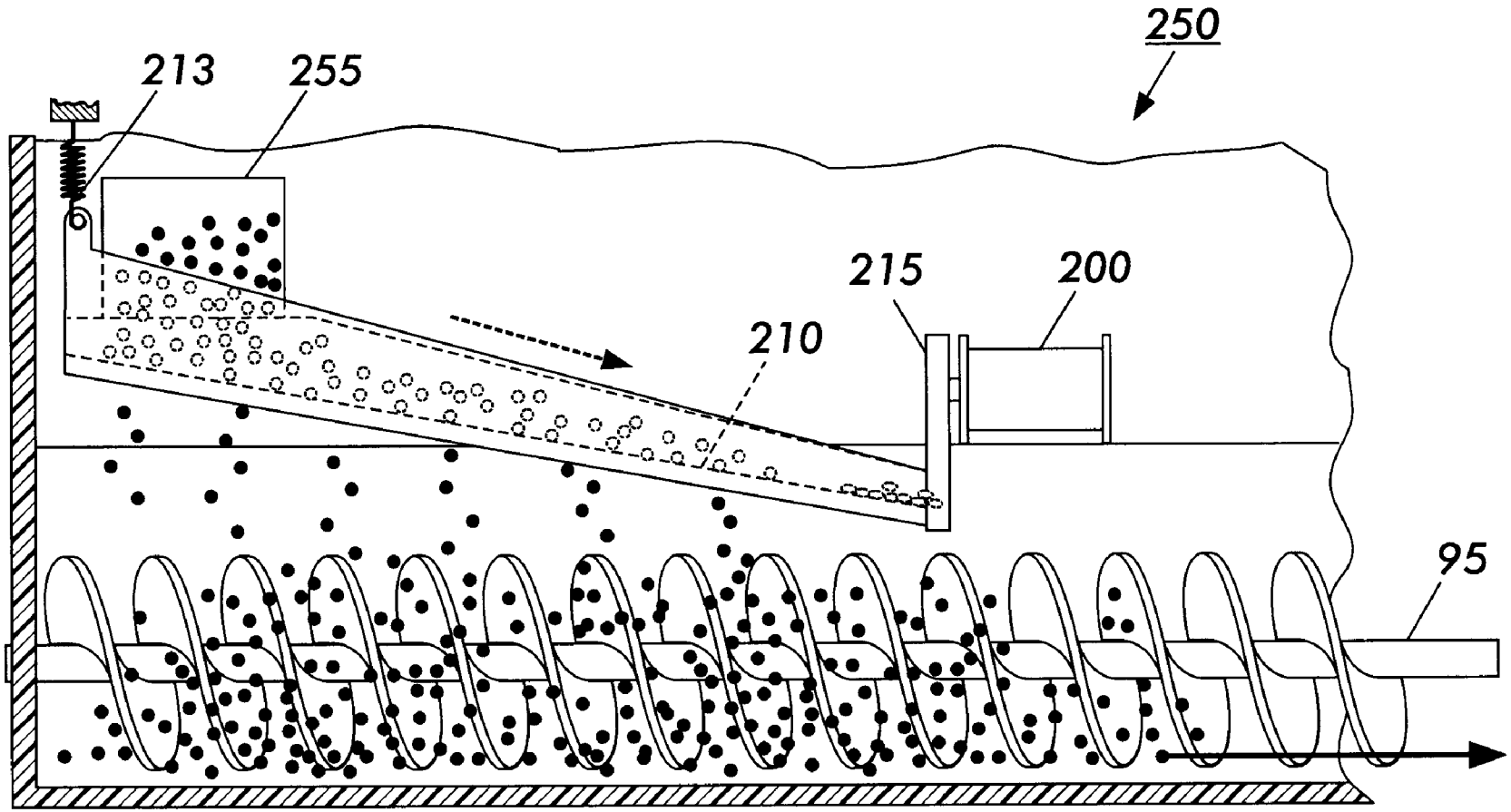
FIG. 5 is a second embodiment of the present invention.

Turning now to FIG. 3, cleaner 250 is shown oriented vertically with the toner particles, developer material, contaminants and debris flowing in the direction of arrow. Cleaner 250 includes a filter screen assembly 210 which is connected to a vibration driving device 200. The vibration driving device 200 preferably is in the form of a mechanical vibrator. The mechanical vibrator may be any suitable vibrator such as those commercially available. The vibrator 200 induces vibration into the filter screen assembly 210 via pivot linkage 212. A chute directs the path of flowing developer material to contact a top inclined portion of the screen assembly 210 and the developer material sieves down the incline slope to a lower portion of screen assembly 210. Vibrator 200 operatively connected to the lower portion of screen assembly 210 provides a movement of travel. Alternatively, as shown in FIG. 5, cleaner 250 can be pivotally innovated at spring 213 and vibrator 200 in form of a electromagnetic drive attracts plate 215 providing movement of travel. The movement of travel of the lower portion of screen assembly 210 is substantially greater than said top inclined portion of screen assembly 210 when vibrated. Controller 300 controls vibrator 200, controller 300 can vary vibrational frequency and amplitude to maintain a steady flow of developer through the top and lower portions of screen assembly 210.

The present invention utilizes screen assembly 210 being mounted at inclined position combined with the application of vibrational energy. The cleaner continuously cleanses a portion of the re-circulated developer material within the developer housing, utilizing the potential energy of the trim zone to provide a minimal height difference in which filtering occurs. Excess trimmed developer is metered through a narrow chute from outside the print area (so the auger supplying material to the magnetic roller is not starved) onto the highest part of the screen and flows down the slope as it is sieved. Flow balance is achieved by compromising a mounting strategy with the frequency and amplitude of the chute and screen combination to insure all material entering the filter passes through it. The filter material is then dispersed evenly along the filter length over the transport auger. The mass of the vibrating member is insignificant compared to the housing mass, which minimizes transmission of extraneous vibration. The frequency of vibration is selected such that it does not resonate at the natural frequency of the housing or any harmonic thereof. For example, a square wave vibration pattern is used.

The amplitude, spring stiffness and gap between the vibrator and plate are balanced such that the material is self-metered through the screen assembly. As material fills the assembly, the vibration is dampened, decreasing the amplitude, thereby limiting the amount that flows down the chute and enters the screen.

Other embodiments and modifications of the present invention may occur to those skilled in the art subsequent to a review of the information presented herein; these embodiments and modifications, as well as equivalents thereof, are also included within the scope of this invention.

We claim:

1. A system for removing contaminates from comprising:

a filter system, positioned in a path of flowing developer material, said filter system having a screen for permitting developer material to travel therethrough while inhibiting contaminants from traveling therethrough when vibrated; said screen being inclined to the path of flowing developer material;

a vibration driver, operatively connected to said screen, for vibrating said screen; and a controller, in communication with said vibration driver, for vary frequency and magnitude of said vibration driver to maintain a steady flow of developer material through said screen.

2. The system according to claim 1, wherein said frequency is square wave vibration pattern.

3. The system according to claim 1, further comprising a chute for directing said path of flowing developer material to contact a top inclined portion of said screen and sieved down the incline slope to a lower portion of said screen.

4. The system according to claim 3, wherein said vibration driver, operatively connected to said lower portion of said screen to provide a movement of travel.

5. The system according to claim 4, wherein the movement of travel of the lower portion of said screen is substantial greater than said top inclined portion of said screen when vibrated.

6. An electrophotographic printing machine, wherein an electrostatic latent image recorded on a photoconductive member is developed to form a visible image thereof, said electrophotographic printing machine including a system, for removing contaminants from toner in a developer housing, the system comprising:

a filter system, positioned in a path of flowing developer material, said filter system having a screen for permitting developer material to travel therethrough while inhibiting contaminants from traveling therethrough when vibrated; said screen being inclined to the path of flowing developer material;

a vibration driver, connected operatively to said screen, for vibrating said screen; and a controller, in communication with said vibration driver, for vary frequency and magnitude of said vibration driver to maintain a steady flow of developer material throuah said screen.

7. The system according to claim 6, wherein said frequency is square wave vibration pattern.

8. The system according to claim 6, further comprising a chute for directing said path of flowing developer material to contact a top inclined portion of said screen and sieved down the incline slop to a lower portion of said screen.

9. The system according to claim 6, wherein said vibration driver, operatively connected to said lower portion of said screen to provide a movement of travel.

10. The system according to claim 9, wherein the movement of travel of the lower portion of said screen is substantially greater than said top inclined portion of said screen when vibrated.

* * * * *